US007365483B2

(12) United States Patent
Chi et al.

(10) Patent No.: US 7,365,483 B2
(45) Date of Patent: Apr. 29, 2008

(54) FIELD EMISSION DISPLAY HAVING GRID PLATE WITH MULTI-LAYERED STRUCTURE

(75) Inventors: Eung-Joon Chi, Seoul (KR); Sung-Hwan Jin, Suwon-si (KR); Kwang-Sun Ji, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 278 days.

(21) Appl. No.: 10/807,916

(22) Filed: Mar. 24, 2004

(65) Prior Publication Data

US 2005/0116600 A1 Jun. 2, 2005

(30) Foreign Application Priority Data

Mar. 27, 2003 (KR) ..... 10-2003-0019225

(51) Int. Cl.

| | |
|---|---|
| ***H01J 63/02*** | (2006.01) |
| ***H01J 1/62*** | (2006.01) |
| ***H01J 1/88*** | (2006.01) |
| ***H01J 19/42*** | (2006.01) |

(52) U.S. Cl. ..... 313/497; 313/292; 313/495; 313/496

(58) Field of Classification Search ..... 313/497, 313/292, 495, 496

See application file for complete search history.

(56) References Cited

U.S. PATENT DOCUMENTS

| | | | | |
|---|---|---|---|---|
| 5,264,758 | A * | 11/1993 | Iijima et al. | 313/584 |
| 5,936,343 | A * | 8/1999 | Fushimi et al. | 313/495 |
| 6,062,931 | A | 5/2000 | Chuang et al. | |
| 6,097,138 | A * | 8/2000 | Nakamoto | 313/309 |
| 6,144,153 | A * | 11/2000 | Nakatani | 313/495 |
| 6,400,091 | B1 | 6/2002 | Deguchi et al. | |
| 6,583,549 | B2 * | 6/2003 | Takenaka et al. | 313/422 |
| 6,621,232 | B2 | 9/2003 | Jo et al. | |
| 6,756,729 | B1 | 6/2004 | Na et al. | |
| 6,791,278 | B2 | 9/2004 | Russ et al. | |
| 7,042,144 | B2 * | 5/2006 | Takahashi et al. | 313/292 |

(Continued)

FOREIGN PATENT DOCUMENTS

| | | |
|---|---|---|
| KR | 2002-0078977 | 10/2002 |

OTHER PUBLICATIONS

Korean Patent Abstracts, Publication No. 1020020078977 A, dated Oct. 19, 2002, in the name of Jae Cheol Cha et al.

*Primary Examiner*—Allen C. Ho
(74) *Attorney, Agent, or Firm*—Christie, Parker & Hale, LLP

(57) ABSTRACT

A field emission display including a first substrate and a second substrate opposing one another with a predetermined gap therebetween. An electron emission assembly is formed on the first substrate that emits electrons by the formation of an electric field. An illumination assembly is formed on the second substrate that realizes the display of images by the emitted electrons. A grid plate is mounted between the first and second substrates and functions to focus the emitted electrons. The grid plate includes a mask section having a plurality of apertures for passing the electrons, and supports mounted to one side of the mask section and extending in a direction toward the first substrate to rest on the same and support the mask section. The mask section and the supports are made of same material or two different materials.

6 Claims, 8 Drawing Sheets

U.S. PATENT DOCUMENTS

| | | | | |
|---|---|---|---|---|
| 7,090,555 | B2 | 8/2006 | Lee et al. | |
| 2002/0017875 | A1* | 2/2002 | Lee et al. | 315/169.1 |
| 2002/0036460 | A1 | 3/2002 | Takenaka et al. | |
| 2004/0124762 | A1* | 7/2004 | Fushimi | 313/497 |
| 2005/0077812 | A1 | 4/2005 | Takenaka | |

* cited by examiner

FIELD EMISSION DISPLAY HAVING GRID PLATE WITH MULTI-LAYERED STRUCTURE

CROSS REFERENCE TO RELATED APPLICATION

This application claims priority to and the benefit of Korea Patent Application No. 2003-0019225 filed on Mar. 27, 2003 in the Korean Intellectual Property Office, the entire content of which is incorporated herein by reference.

BACKGROUND OF THE INVENTION (a) Field of the Invention

The present invention relates to a field emission display (FED), and more particularly, to an FED that includes emitters made of a carbon-based material and a grid plate mounted between front and rear substrates.

(b) Description of the Related Art

In modern FEDs, a thick-layer process such as screen printing is used to form electron emission sources. The emission sources are formed using a carbon-based material that emits electrons at low voltage driving conditions of 10-100 V.

Carbon-based materials suitable for forming the emitters include graphite, diamond, diamond-like carbon, and carbon nanotubes. Among these, carbon nanotubes appear to be very promising for use as emitters because of their extremely minute tips (i.e., a radius of curvature of approximately tens to several tens of nanometers), and because carbon nanotubes are able to emit electrons in low electric field conditions of about 1-10 V/μm.

Examples of conventional FEDs utilizing carbon nanotubes are disclosed in U.S. Pat. Nos. 6,062,931 and 6,097,138.

When the FEDs employ a triode structure of cathode electrodes, an anode electrode, and gate electrodes, they can have the type of triode structure shown in FIG. 12. With reference to FIG. 12, gate electrodes 5 are first formed on a substrate on which emitters 1 are to be formed, for example, rear substrate 3. Insulation layer 7 is formed on gate electrodes 5, then cathode electrodes 9 are formed on insulation layer 7. Emitters 1 are formed on cathode electrodes 9. Further, anode electrode 15 is formed on a substrate on which phosphor layers 11 are to be formed, for example, front substate 13. Phosphor layers 11 are then typically formed on anode electrode 15.

Further, mesh-type grid plate 17 is mounted between front substrate 13 and rear substrate 3. A plurality of openings 17*a* through which electron beams pass are formed in grid plate 17. Grid plate 17 acts to focus the electron beams emitted from emitters 1. A plurality of upper spacers 19 and a plurality of lower spacers 21 are formed between front substrate 13 and rear substrate 3 to maintain a predetermined gap between front substrate 13 and rear substrate 3.

However, in practice, many of the electron beams emitted from the emitters are unable to pass through designated openings 17*a* of grid plate 17 and also experience misdirection away from their intended paths. This is caused by the fact that most electron beams are emitted from the edges of emitters 1 and at predetermined angles to rear substrate 3. The electron beams then either arc toward front substrate 13 while passing through openings 17*a* of grid plate 17, or fail to pass through openings 17*a* and strike grid plate 17.

Furthermore, grid plate 17 is being made to increasingly larger dimensions following recent trends of providing greater screen sizes in FEDs. However, grid plate 17 begins to sag for such large sizes. This is because of the minimal thickness of grid plate 17, which is typically made of a metal sheet. Openings 17*a* become displaced as a result.

Therefore, many of the electron beams strike grid plate 17 and are prevented from further movement. The electron beams can strike grid plate 17 and be deflected to travel along an altered path, or pass through one of openings 17*a* of metal grid 17 corresponding to a pixel adjacent to the intended pixel. If emitter 1 from which the electron beam arrows are drawn in FIG. 12 is used as an example, the electron beams emitted from emitter 1 land on phosphor layer 11 of the intended phosphor to illuminate the same and also land on phosphor layers 11' of pixels adjacent to the intended pixel to illuminate the same. Picture quality is reduced by the landing of the electron beams on phosphor layers 11' of unintended pixels.

To prevent sagging of grid plate 17, the number of lower spacers 21 may be increased to thereby minimize the spacing between them. However, this approach can cause the manufacture of the FED to be difficult as a result of the complications involved in having to arrange a larger number of lower spacers 21.

SUMMARY OF THE INVENTION

In one exemplary embodiment of the present invention, there is provided a field emission display that minimizes a size of openings of a grid plate while avoiding the problems associated with a decreased width of the grid plate, thereby preventing the illumination of unintended pixels by the spreading of electron beams. Also, the field emission display mounts the grid plate without the use of lower spacers to avoid the difficulties involved in arranging the lower spacers during manufacture.

In an exemplary embodiment of the present invention, a field emission display includes a first substrate and a second substrate opposing one another with a predetermined gap therebetween. An electron emission assembly is formed on the first substrate to emit electrons by the formation of an electric field. An illumination assembly is formed on the second substrate that realizes the display of images by the emitted electrons. A grid plate is mounted between the first and second substrates and functions to focus the emitted electrons. The grid plate includes a mask section having a plurality of apertures for passing the electrons, and supports mounted to one side of the mask section and extending in a direction toward the first substrate to support the mask section from the first substrate.

The electron emission assembly includes electron emission sources, and electrodes for causing the emission of electrons from the electron emission sources. The electrodes include cathode electrodes and gate electrodes formed in a stripe pattern. The cathode electrodes and the gate electrodes are substantially perpendicular to one another and insulated from one another by an insulation layer.

The supports may be mounted on the insulation layer, and when providing an auxiliary insulation layer formed on an uppermost layer of the first substrate, the supports are mounted on the auxiliary insulation layer.

Preferably, the mask section is formed to a thickness of 20-100 μm, and each of the apertures formed in the mask section has a minimal size of 20-100 μm. Further, a sectional aspect ratio of each of the apertures formed in the mask section is 5:1-1:1.

The supports may be formed between the apertures formed in the mask section and along one direction, or between the apertures formed in the mask section and along perpendicular directions. Further, the supports may be formed between at most every other row of the apertures formed in the mask section and along one direction.

The mask section and the supports may be made of the same metal, or may be made of different metals having dissimilar etching rates. It is also possible for the mask to be made of a metal and the supports of an insulation material.

DETAILED DESCRIPTION

Figure 1A:
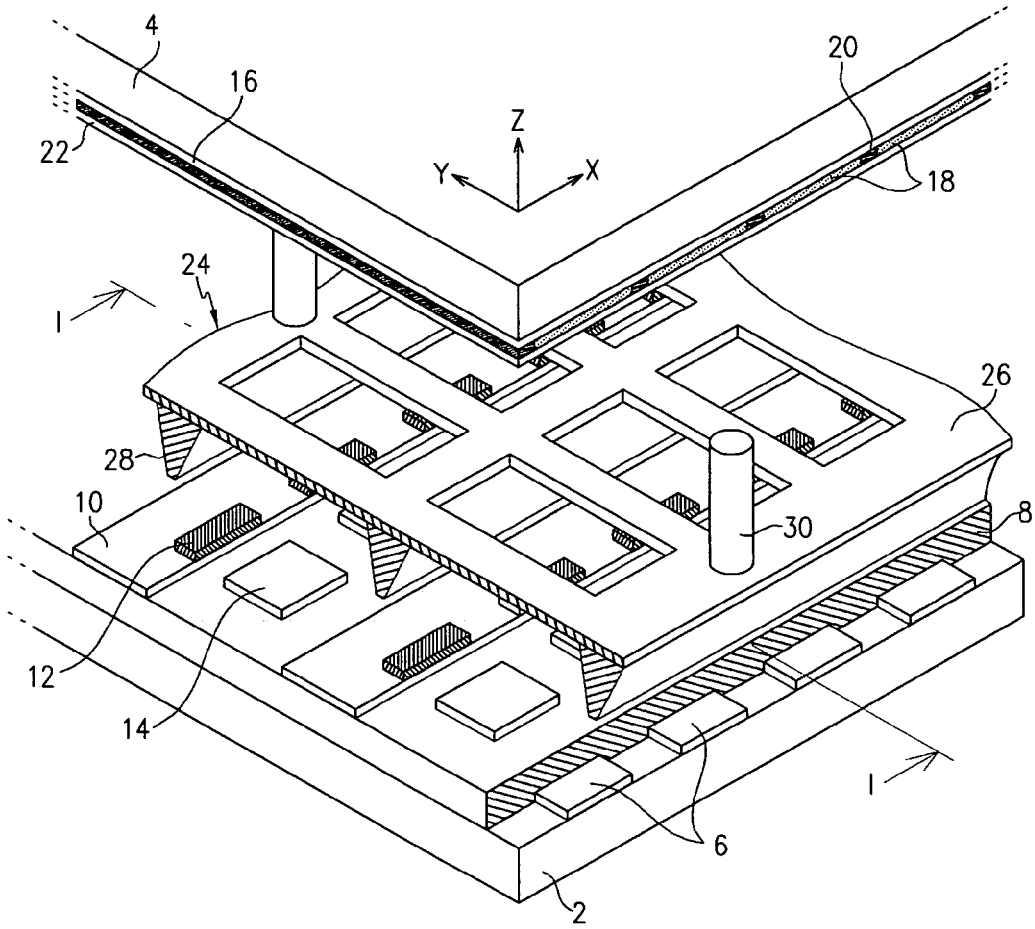
FIG. 1A is a partial exploded perspective and pictorial view of a field emission display according to an exemplary embodiment of the present invention.
Figure 2:
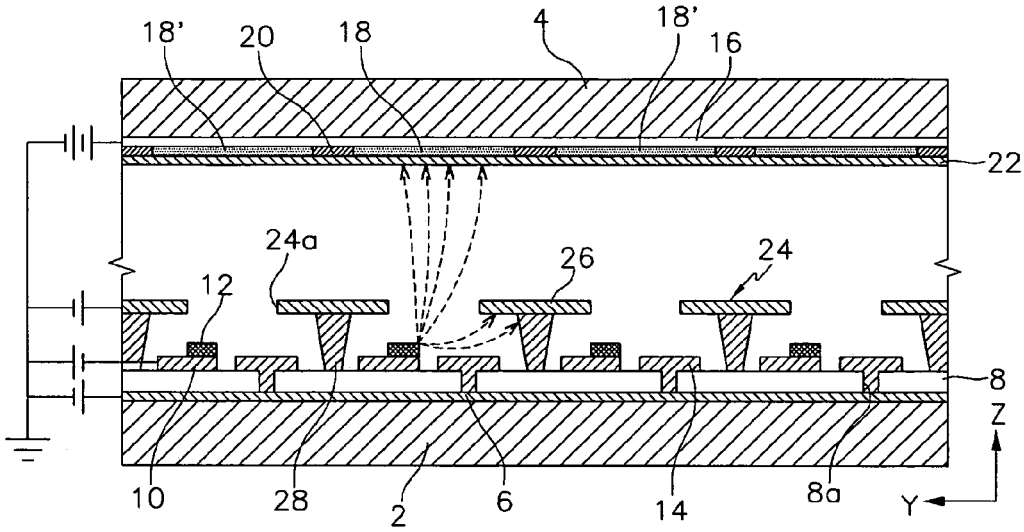
FIG. 2 is a partial sectional view of the field emission display of FIG. 1A taken along the line I-I, shown in an assembled state.

Referring to FIGS. 1A and 2, the FED includes first substrate 2 and second substrate 4 provided opposing one another with a predetermined gap therebetween. A structure to enable the emission of electrons by forming an electric field is provided on first substrate 2, and a structure to enable the realization of predetermined images by interaction with emitted electrons is provided on second substrate 4.

In more detail, gate electrodes 6 are formed on first substrate 2 in a stripe pattern along one direction (for example, axis Y direction of the drawings). Further, insulation layer 8 is formed over an entire surface of first substrate 2 covering gate electrodes 6. Cathode electrodes 10 are formed on insulation layer 8 in a stripe pattern along a direction perpendicular to the direction of long axes of gate electrodes 6 (for example, axis X direction of the drawings).

Pixel regions are defined by the intersection of gate electrodes 6 and cathode electrodes 10. Electron emission sources, that is, emitters 12, are positioned along one long edge of each of cathode electrodes 10 corresponding to the location of the pixels. Further, counter electrodes 14 are provided at a predetermined distance from cathode electrodes 10. Counter electrodes 14 act as a pathway through which an electric field of gate electrodes 6 is directed to an exposed surface area of insulation layer 8.

Counter electrodes 14 contact gate electrodes 6 to be electrically connected to the same through via openings 8*a* formed in insulation layer 8. Therefore, when a predetermined drive voltage is applied to gate electrodes 6 such that an electric field for electron emission is formed between gate electrodes 6 and emitters 12, a voltage of gate electrodes 6 is directed toward peripheries of emitters 12 such that a greater electric field is applied to the same. This results in better emission of electrons from emitters 12.

The emitters 12 are made of a carbon-based material such as carbon nanotubes, graphite, diamond, diamond-like carbon, and $C_{60}$ (Fullerene), or are made of a mixture of these carbon-based materials. Carbon nanotubes are used in exemplary embodiments of the present invention.

Figure 1B:
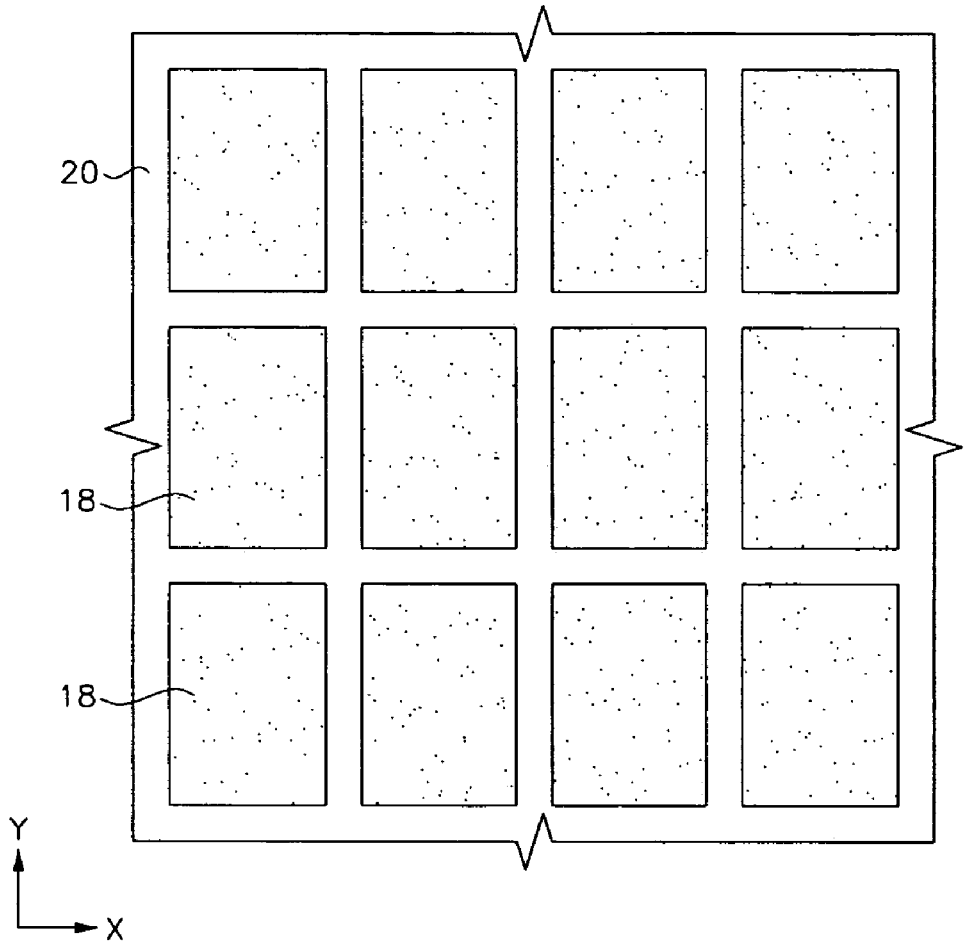
FIG. 1B is a partial plan view of phosphor regions surrounded by a black matrix in the FED of FIG. 1A, as formed on an anode electrode of a second substrate.

Formed on a surface of second substrate 4 opposing first substrate 2 are anode electrode 16, and red (R), green (G), and blue (B) phosphor layers 18 formed on anode electrode 16. R, G, and B phosphor layers 18 as depicted in FIG. 1B are formed in a predetermined pattern, for example, in a matrix pattern having rows and columns of phosphor regions, each phosphor region corresponding to one of the pixel regions, and at a predetermined distance with respect to one another. Further, as depicted in FIG. 1B, black matrix 20 having a lattice pattern surrounds the phosphor regions to improve screen contrast. In other words, each phosphor region of phosphor layers 18 is disposed within a corresponding one of the cells defined by the lattice pattern of black matrix 20.

Finally, thin metal film 22 made of a metal such as aluminum is formed on phosphor layers 18 and black matrix 20. Thin metal film 22 increases screen brightness by providing a conventional metal back effect, and acts to transmit an electric charge accumulated on phosphor layers 18 to outside the FED to improve voltage resistance characteristics of the same.

As an alternative to the above configuration, it is also possible to form R, G, and B phosphor layers 18 and black matrix 20 directly on the surface of second substrate 4 opposing first substrate 2 (rather than forming these elements on anode electrode 16). Thin metal film 22 is then formed on phosphor layers 18 and black matrix 20 as in the above. In this case, it is thin metal film 22 that receives a high voltage to act as an anode electrode. Since a higher voltage can be applied to thin metal film 22 than to the conventional transparent electrode, improved screen brightness can be achieved.

First substrate 2 and second substrate 4 structured as in the above are sealed using a sealant. Sealing is performed in a state where there is a predetermined gap between first substrate 2 and second substrate 4. The air between first substrate 2 and second substrate 4 is exhausted to form a vacuum therebetween.

Further, mesh-type grid plate 24 having a plurality of apertures 24*a* is positioned between first substrate 2 and second substrate 4. As an example, apertures 24*a* may be formed such that one is located in each of the pixel regions where gate electrodes 6 and cathode electrodes 10 intersect. Grid plate 24 acts to focus the electrons emitted from emitters 12, and to prevent damage to first substrate 2 caused when arcing occurs in the FED.

In this exemplary embodiment, a structure is used for grid plate 24 that blocks the electron beams emitted from emitters 12 that are diverted and head toward phosphor layers 18 of unintended pixels. Also, grid plate 24 utilizes a structure that prevents sagging of the same. This is realized without the use of the conventional lower spacers.

Figure 3:
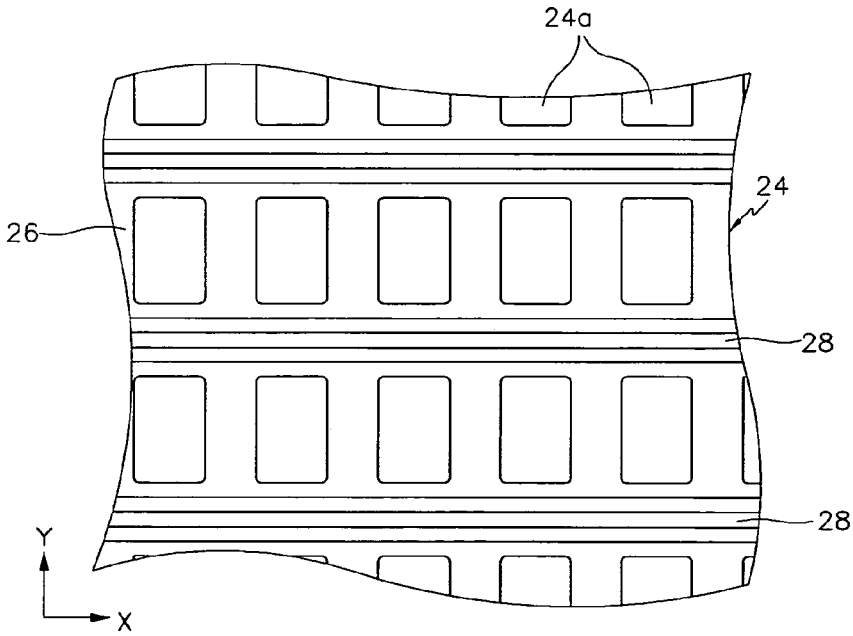
FIG. 3 is a partial plan view of a rear of a grid plate according to an exemplary embodiment of the present invention.
Figure 4:
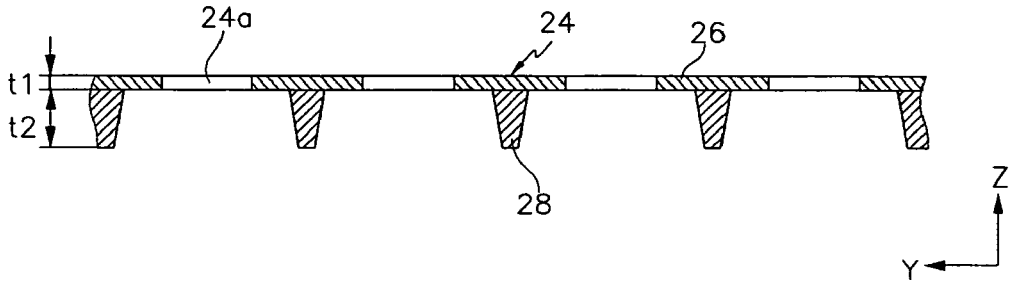
FIG. 4 is a partial sectional view of the grid plate of FIG. 3.

FIG. 3 is a partial plan view of a rear of grid plate 24, and FIG. 4 is a partial sectional view of grid plate 24 of FIG. 3. With reference to FIGS. 3 and 4, grid plate 24 includes mask section 26 having predetermined thickness t1, and a plurality of apertures 24*a*. At least one aperture 24*a* is formed corresponding to each of the pixel regions. Grid plate 24 also includes supports 28 that are mounted contacting a surface of mask section 26 opposing first substrate 2 in non-pixel regions between apertures 24*a*. Supports 28 have predetermined height t2 that is greater than thickness t1 of mask section 26. In an exemplary embodiment supports 28 taper over predetermined height t2 such that the contacting area of the supports toward the mask section tends to be larger than the contacting area of the supports toward the first substrate, providing a generally more stabilized structure geometrically.

In one exemplary embodiment mask section 26 and supports 28 are made of the same conducting material. In another exemplary embodiment mask section 26 and supports 28 are made of two different types of materials. In the latter case, examples include making mask section 26 using a conducting material and supports 28 using an insulating material, and forming mask section 26 and supports 28 using two different types of metal materials having different etching rates.

The supports 28 are formed in a stripe pattern between apertures 24*a* of mask section 26 and along one direction of the same, for example, along the direction cathode electrodes 10 are formed (axis X direction). With the mounting of grid plate 24 between first substrate 2 and second substrate 4 as described above, supports 28 are positioned on first substrate 2 (i.e., on insulation layer 8) to thereby function similarly to conventional lower spacers.

That is, supports 28 that are positioned at furthermost outer locations of mask section 26 function as a frame to support grid plate 24 to thereby prevent deformation of the same during manufacture, while supports 28 positioned inwardly from these outermost supports 28 function as lower spacers that prevent shorts from occurring between cathode electrodes 10 and grid plate 24 and/or emitters 12 and grid plate 24, and to maintain the vacuum state in the FED.

Accordingly, grid plate 24 has an improved structural strength as a result of supports 28. Also, mask section 26 of grid plate 24 and apertures 24*a* formed therein are distanced from cathode electrodes 10 by an amount approximately corresponding to height t2 of supports 18, preferably 30-200 μm.

By forming grid plate 24 in a multi-layer structure using mask section 26 and supports 28 as described of above, thickness t1 of mask section 26 of grid plate 24 may be minimally formed to approximately 20-100 μm. Also, apertures 24*a* may be formed to a minimal size in mask section 26 using conventional etching techniques, that is, having a minimum width of approximately 20-100 μm. Therefore, a sectional aspect ratio of each of apertures 24*a* in mask section 26 is 5:1-1:1.

In sum, apertures 24*a* are formed to a minimal size in mask section 26, and deformation, sagging, and vibration of mask section 26 are significantly decreased by supports 28, even when grid plate 24 is made to large sizes. Therefore, problems associated with thick mask section 26, that is, difficulties in manufacture, generation of noise, and the formation of short circuits between cathode electrodes 10 and grid plate 24 and/or emitters 12 and grid plate 24, are prevented.

In addition, since supports 28 are mounted parallel to cathode electrodes 10 in the non-pixel regions between cathode electrodes 10, supports 28 act as partition walls to separate cathode electrodes 10 from one another. This partition wall function of supports 28 is such that the electron beams emitted from emitters 12 that stray from their intended paths and toward phosphor layers 26 of pixels adjacent to the target pixels are intercepted. In particular, the illumination of the wrong, unintended pixels is prevented by supports 28.

In the case where mask section 26 and supports 28 are made of the same metal material, mask section 26 and supports 28 are separately manufactured into the shapes as described above, then a process is performed to join these elements.

Also, in the case where mask section 26 and supports 28 of grid plate 24 are made of metals having different etching rates, a metal plate (not shown) realized by combining a first metal having thickness t1 and a second metal having height t2 and a different etching rate as the first metal is prepared. Using this difference in etching rates between the first and second metals, conventional etching procedures are used to perform asymmetrical etching of the metal plate to thereby realize the structure of grid plate 24 as described above.

Alternatively, following the formation of mask section 26 by forming a plurality of apertures 24*a* in the first metal of thickness t1, and the patterning of the second metal having height t2 to form supports 28, the first metal and the second metal are joined to thereby realize the structure of grid plate 24 as described above.

Grid plate 24 is mounted on first substrate 2 such that mask section 26 thereof is at a predetermined distance from first substrate 2 as a result of supports 28. Also, a plurality of spacers 30 are mounted between second substrate 4 and grid plate 24 in non-pixel regions such that a predetermined distance is maintained between second substrate 4 and grid plate 24.

In the FED structured as in the above, predetermined external voltages are applied to gate electrodes 6, cathode electrodes 10, anode electrode 16, and grid plate 24 to thereby drive the FED. As an example, a positive voltage of a few to a few tens of volts is applied to gate electrodes 6, a negative voltage of a few to a few tens of volts is applied to cathode electrodes 10, a positive voltage of a few hundred to a few thousand volts is applied to anode electrode 16, and a positive voltage of a few tens to a few hundred volts is applied to grid plate 24.

Therefore, with reference to FIG. 2, an electric field is generated in the vicinity of emitters 12 by the difference in voltage between gate electrodes 6 and cathode electrodes 10 such that electrons are emitted from emitters 12. The electron beams formed as a result are attracted by the positive voltage applied to grid plate 24 to pass through apertures 24*a* thereof while traveling toward second substrate 4. After passing through apertures 24*a* of grid plate 24, the electron beams are attracted by the high positive voltage applied to the anode electrode 16 to thereby land on phosphor layers 18 and illuminate the same.

During the above process, some of the electron beams emitted from emitters 12 do not pass through apertures 24*a* of grid plate 24 corresponding to the intended pixel to be illuminated, and instead spread out toward phosphor layers 18' of adjacent pixels. That is, some of the electron beams stray from their intended paths. However, since apertures 24*a* of mask section 26 of grid plate 24 are formed to a minimal size, mask section 26 blocks the electron beams directed toward phosphor layers 18' of pixels adjacent to the intended pixels to thereby prevent illumination of these phosphor layers 18'. Further, with the formation of supports 28 in the non-pixel regions between cathode electrodes 10 and having height t2, the misdirected electron beams are intercepted and prevented from further movement.

Therefore, in accordance with the present invention the illumination of the wrong pixels is prevented to improve vertical resolution of the picture. Clarity of characters is improved in the vertical direction to enable the same to be more easily read. Further, since lower spacers are unneeded in the exemplary embodiment of the present invention, the procedure in which lower spacers are aligned can be omitted from the manufacturing process.

FIGS. 5-10 are related to various other exemplary embodiments of the present invention. It should be noted that these additional exemplary embodiments use the basic configuration of the exemplary embodiment described above, and so only differences in structure will be explained in detail.

Figure 5:
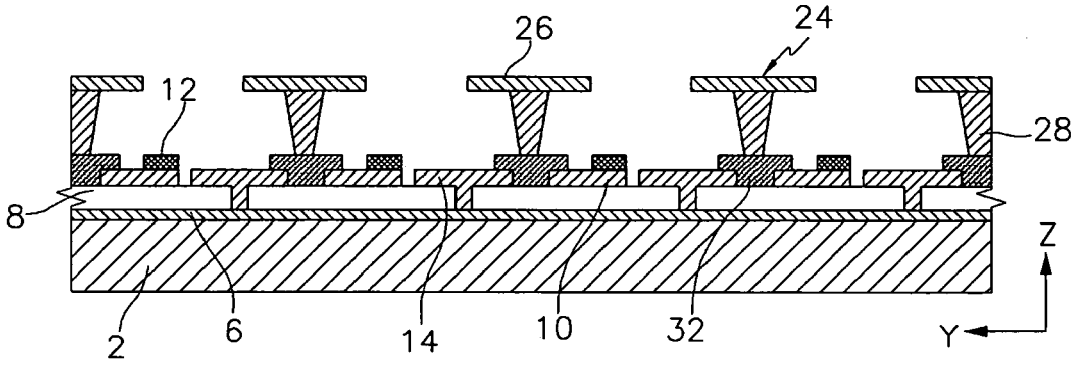
FIG. 5 is a partial sectional view of a field emission display according to another exemplary embodiment of the present invention.

Referring first to FIG. 5, auxiliary insulation layers 32 are formed on insulation layer 8 that extends between pairs of cathode electrodes 10 and counter electrodes 14 in the non-pixel regions, that is, between each of the cathode electrodes 10 and a counter electrode 14 of an adjacent pixel. Supports 28 of grid plate 24 are positioned on auxiliary insulation layers 32.

With this configuration, insulation characteristics between the conductors of grid plate 24, cathode electrodes 10, and counter electrodes 14 are ensured. Also, the process margin when grid plate 24 is mounted on first substrate 2, and the widths of cathode electrode 10 and counter electrodes 14 can be easily ensured.

Figure 6:
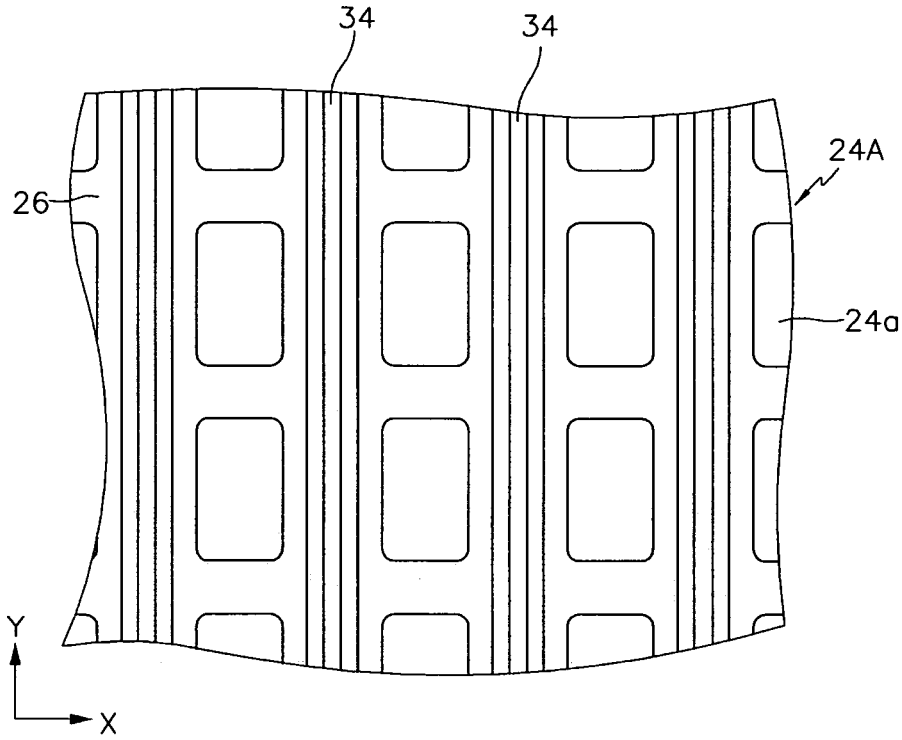
FIGS. 6 and 7 are respectively a partial plan view of a rear of a grid plate and a partial sectional view of a field emission display according to another exemplary embodiment of the present invention.
Figure 7:
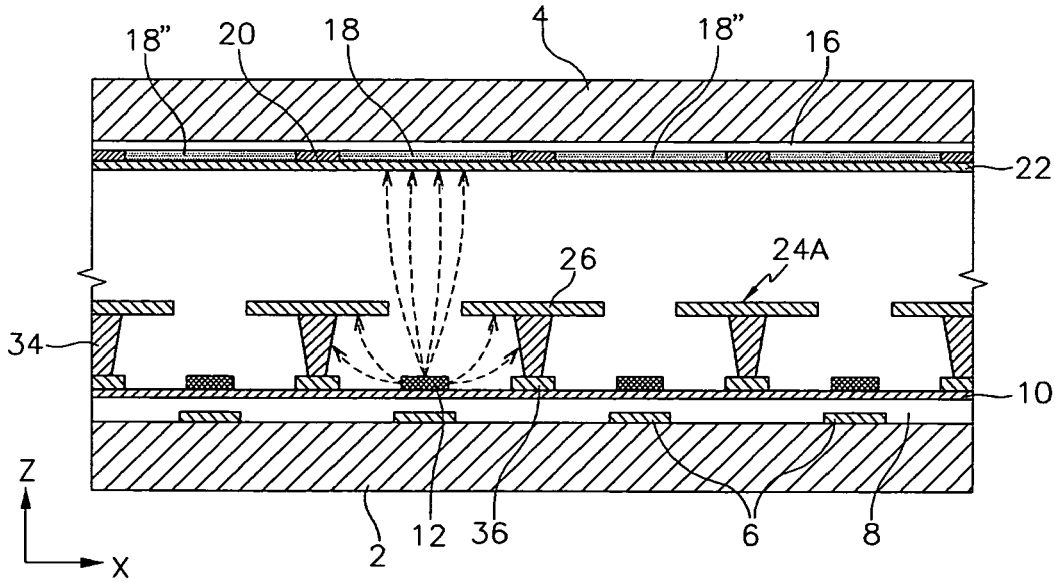

FIGS. 6 and 7 show views of yet another exemplary embodiment of the present invention. Supports 34 mounted to grid plate 24A are formed in a stripe pattern along another direction of mask section 26, for example, along the direction gate electrodes 6 are formed (axis Y direction). Further, auxiliary insulation layers 36 are mounted on cathode electrodes 10 in the same stripe pattern as supports 34, and supports 34 are mounted on auxiliary insulation layers 36. Auxiliary insulation layers 36 act to prevent a short circuit between cathode electrodes 10 and supports 34 when supports 34 are mounted on cathode electrodes 10. However, it is also possible to form supports 34 using an insulation material so that auxiliary insulation layers 36 are unneeded.

Supports 34, with reference to FIG. 7, prevent the spread of electron beams in axis X direction by blocking the electron beams that are misdirected toward the wrong pixels where phosphor layers 18" of another color are located. Accordingly, supports 34 prevent mislanding of the electron beams such that illumination of the wrong pixels is prevented and overall color purity is improved.

Figure 8:
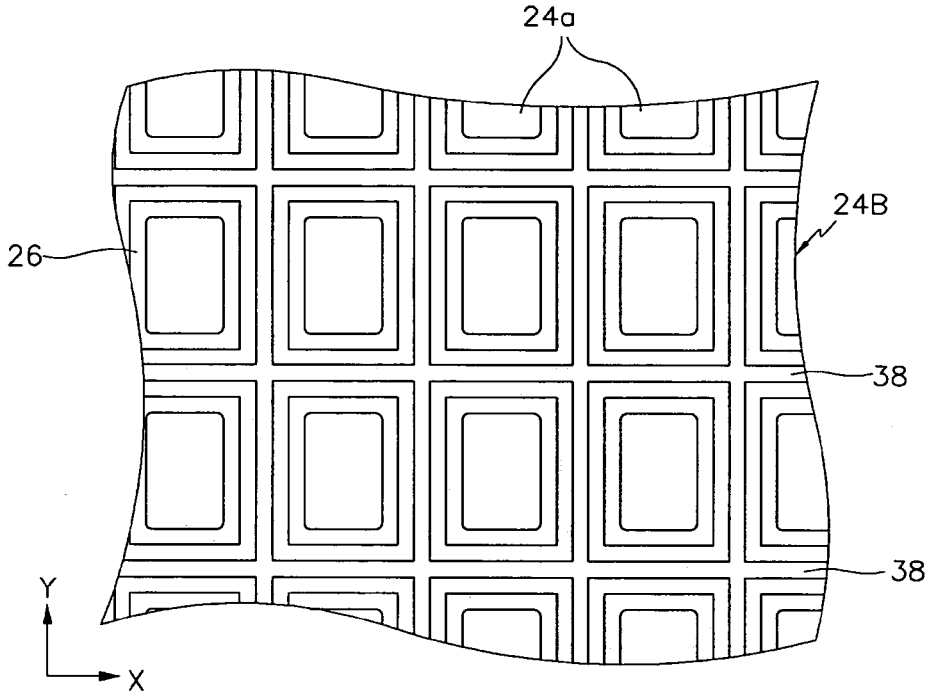
FIGS. 8, 9, and 10 are partial plan views of a rear of a grid plate according to additional exemplary embodiments of the present invention.

FIG. 8 shows another exemplary embodiment of the present invention. In this case, supports 38 mounted to grid plate 24B are formed in a stripe pattern along one direction of mask section 26, for example, along the direction cathode electrodes 10 are formed (axis X direction), and along another direction of mask section 26, for example, along the direction gate electrodes 6 are formed (axis Y direction) to thereby realize a lattice pattern.

Figure 9:
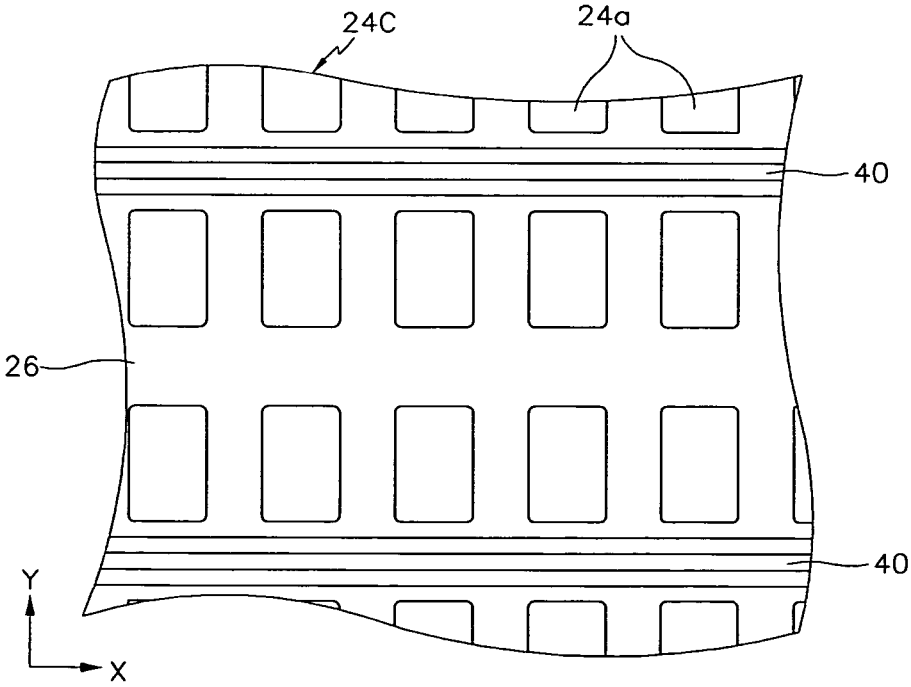

FIG. 9 shows still another exemplary embodiment of the present invention. In this exemplary embodiment, supports 40 of grid plate 24C are formed between at most every other row of apertures 24*a*. Supports 40 may be formed in a stripe pattern along the direction of cathode electrodes 10 (along axis X direction), along the direction of gate electrodes 6 (along axis Y direction) as shown in FIG. 6 (but between at most every other column of apertures 24*a*), or along the direction of cathode electrodes 10 and along the direction of gate electrodes 6 in a lattice pattern as shown in FIG. 8 (but between at most every other row and column of apertures 24*a*).

Figure 10:
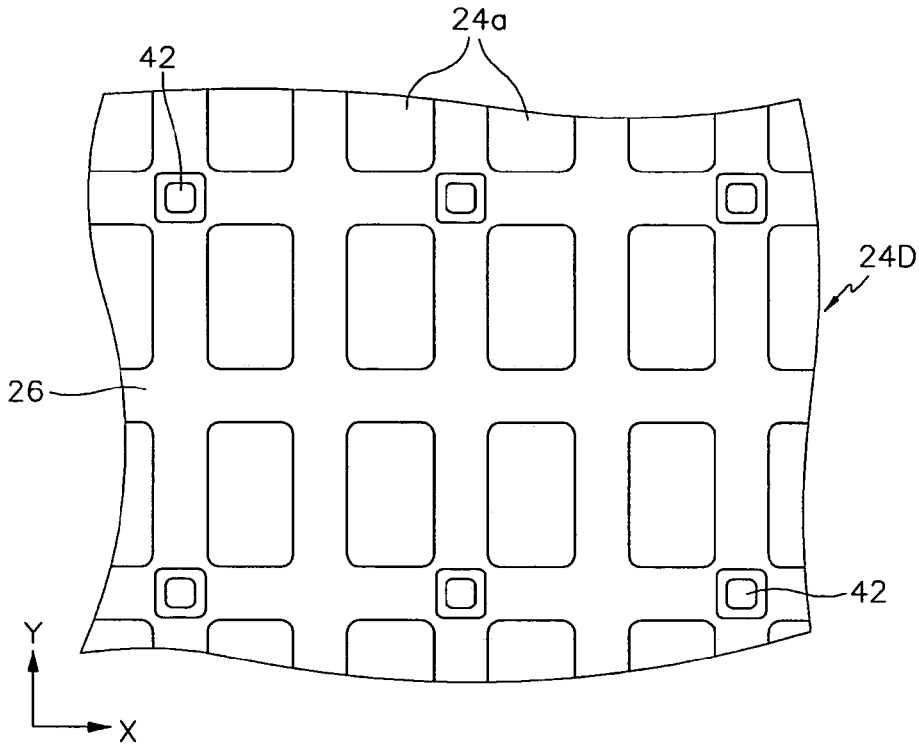

FIG. 10 shows still yet another exemplary embodiment of the present invention. In this exemplary embodiment, supports 42 of grid plate 24 are formed in a dot pattern in non-pixel regions of mask section 26. Supports 42 are formed in a non-continuous manner, that is, not in every non-pixel region between apertures 24*a*.

The supports of the grid plate of the present invention are not limited to the above exemplary embodiments. The shape of the supports and their pattern may be varied as needed.

Although a description was provided above in which gate electrodes 6 are formed under cathode electrodes 10 with insulation layer 8 interposed therebetween, the structure of the electron emitting assembly realized through emitters 12, cathode electrodes 10, and gate electrodes 6 is not limited to the above exemplary embodiments. That is, as shown in FIG. 11, gate electrodes 42 may be mounted on cathode electrodes 44 with the insulation layer interposed therebetween.

Figure 11:
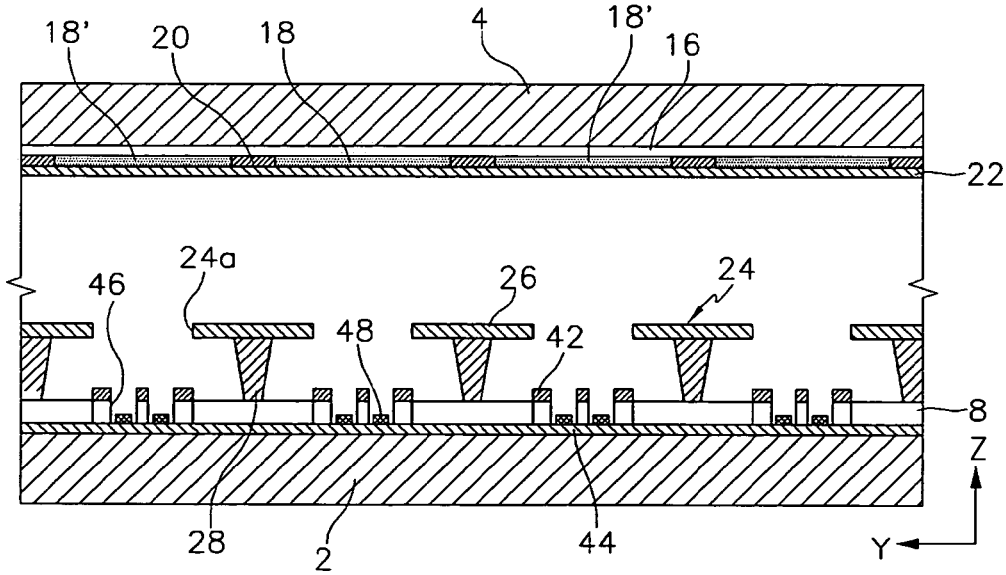
FIG. 11 is a partial section view of the field emission display according to yet another exemplary embodiment of the present invention.
Figure 12:
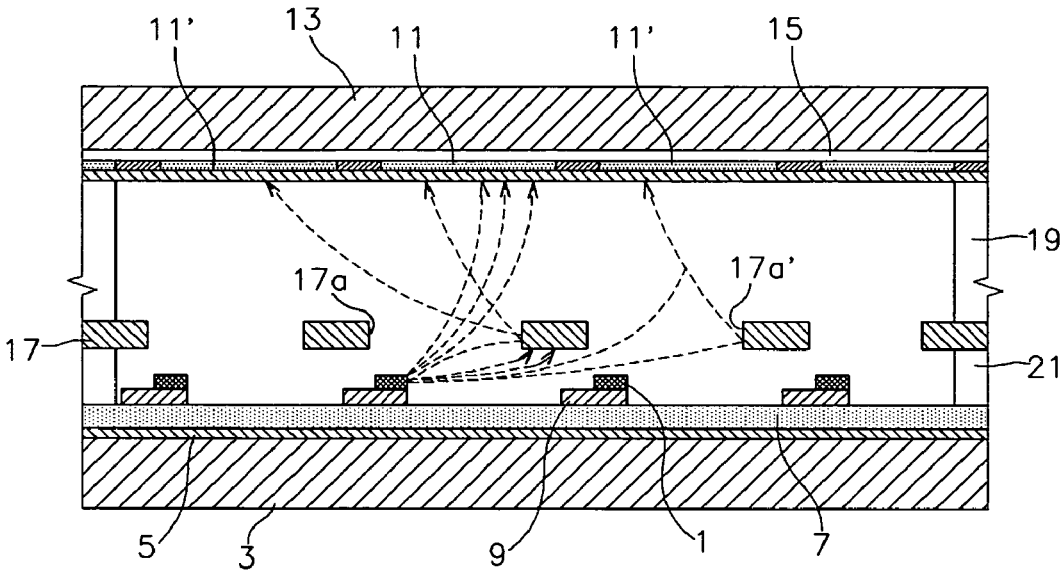
FIG. 12 (Prior Art)
FIG. 12 is a partial sectional view of a conventional field emission display.

With reference to FIG. 11, cathode electrodes 44 and gate electrodes 42 are formed along intersecting directions with insulation layer 8 interposed therebetween. Opening 46 is formed at each of the locations where gate electrodes 42 and cathode electrodes 44, and emitter 48 are positioned on areas of cathode electrodes 44 exposed by openings 46. Driving of the FED shown in FIG. 11 is substantially identical to the driving of the above exemplary embodiments. Therefore, a detailed description thereof will not be provided.

In the FED in accordance with the exemplary embodiments of the present invention described above, the grid plate is formed using a multi-layered structure in which the mask section and the supports are joined together. As a result, the apertures of the mask section may be more minutely formed such that the electron beams emitted from the emitters that spread out and are misdirected toward pixels adjacent to the desired pixels are effectively blocked. Accordingly, the present invention prevents the illumination of the wrong pixels to improve vertical resolution and color purity.

Further, the problems associated with reducing the thickness of the mask section (i.e., manufacturing difficulties, shorts between the electrodes formed on the first substrate, and the generation of noise) are avoided by the use of the supports of the grid plate. The problems associated with the arrangement of lower spacers are also avoided with the use of the supports of the present invention.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A field emission display, comprising:

a first substrate and a second substrate facing one another and having a predetermined gap therebetween;

an electron emission assembly formed on the first substrate for emitting electrons;

an illumination assembly formed on the second substrate for displaying images responsive to electrons emitted from the electron emission assembly; and a grid plate mounted between the first substrate and the second substrate and configured to focus the electrons emitted from the electron emission assembly;

wherein the grid plate includes a mask section having a plurality of apertures for passing the electrons and having supports mounted to one side of the mask section and extending in a direction toward the first substrate to support the mask section from the first substrate, wherein the mask section has a predetermined mask section thickness and the supports have a predetermined support height, the predetermined support height being greater than the predetermined mask section thickness, wherein the supports are made of a conducting material, and wherein the mask section and the supports are made of same material.

2. A field emission display, comprising:

a first substrate and a second substrate facing one another and having a predetermined gap therebetween;

an electron emission assembly formed on the first substrate for emitting electrons;

an illumination assembly formed on the second substrate for displaying images responsive to electrons emitted from the electron emission assembly; and a grid plate mounted between the first substrate and the second substrate and configured to focus the electrons emitted from the electron emission assembly;

wherein the grid plate includes a mask section having a plurality of apertures for passing the electrons and having supports mounted to one side of the mask section and extending in a direction toward the first substrate to support the mask section from the first substrate, wherein the mask section has a predetermined mask section thickness and the supports have a predetermined support height, the predetermined support height being greater than the predetermined mask section thickness, wherein the supports are made of a conducting material, and wherein the supports are formed between at most every other row of the apertures formed in the mask section and along one direction to thereby form a stripe pattern.

3. A field emission display, comprising:

a first substrate and a second substrate facing one another and having a predetermined gap therebetween;

an electron emission assembly formed on the first substrate for emitting electrons;

an illumination assembly formed on the second substrate for displaying images responsive to electrons emitted from the electron emission assembly; and a grid plate mounted between the first substrate and the second substrate and configured to focus the electrons emitted from the electron emission assembly;

wherein the grid plate includes a mask section having a plurality of apertures for passing the electrons and having supports mounted to one side of the mask section and extending in a direction toward the first substrate to support the mask section from the first substrate, wherein the mask section has a predetermined mask section thickness and the supports have a predetermined support height, the predetermined support height being greater than the predetermined mask section thickness, wherein the supports are made of a conducting material, and wherein the supports taper such that a contacting area of the supports toward the mask section are larger than a contacting area of the supports toward the first substrate.

4. A field emission display, comprising:

a first substrate and a second substrate facing one another and having a predetermined gap therebetween;

an electron emission assembly formed on the first substrate for emitting electrons;

an illumination assembly formed on the second substrate for displaying images responsive to electrons emitted from the electron emission assembly; and a grid plate mounted between the first substrate and the second substrate and configured to focus the electrons emitted from the electron emission assembly;

wherein the grid plate includes a mask section having a plurality of apertures for passing the electrons and having supports mounted to one side of the mask section and extending in a direction toward the first substrate to support the mask section from the first substrate, wherein the mask section has a predetermined mask section thickness and the supports have a predetermined support height, the predetermined support height being greater than the predetermined mask section thickness, wherein the supports are made of a conducting material, wherein the electron emission assembly comprises electron emission sources and electrodes for causing the emission of electrons from the electron emission sources, wherein the electrodes include cathode electrodes and gate electrodes formed in a stripe pattern, wherein the cathode electrodes and the gate electrodes are substantially perpendicular to one another and insulated from one another by an insulation layer, and wherein the cathode electrodes are formed on the insulation layer over the gate electrodes, and the electron emission sources are mounted on the cathode electrodes.

5. A field emission display, comprising:

a first substrate and a second substrate facing one another and having a predetermined gap therebetween;

an electron emission assembly formed on the first substrate for emiffing electrons;

an illumination assembly formed on the second substrate for displaying images responsive to electrons emitted from the electron emission assembly; and a grid plate mounted between the first substrate and the second substrate and configured to focus the electrons emitted from the electron emission assembly;

wherein the grid plate includes a mask section having a plurality of apertures for passing the electrons and having supports mounted to one side of the mask section and extending in a direction toward the first substrate to support the mask section from the first substrate, wherein the mask section has a predetermined mask section thickness and the supports have a predetermined support height, the predetermined support height being greater than the predetermined mask section thickness, wherein the supports are made of a conducting material, wherein the electron emission assembly comprises electron emission sources and electrodes for causing the emission of electrons from the electron emission sources, wherein the electrodes include cathode electrodes and gate electrodes formed in a stripe pattern, wherein the cathode electrodes and the gate electrodes are substantially perpendicular to one another and insulated from one another by an insulation layer, and wherein:

the gate electrodes are formed on the insulation layer over the cathode electrodes;

an opening is formed in the gate electrodes at each region where the cathode electrodes and the gate electrodes intersect; and the electron emission sources are formed on surface areas of the cathode electrode exposed by the openings.

6. A grid plate apparatus for focusing electrons emitted from emitters in a field emission display having a first substrate and a second substrate facing one another with a predetermined gap therebetween. an electron emission assembly formed on the first substrate for emitting electrons, and an illumination assembly formed on the second substrate for displaying images responsive to the electrons, the grid plate apparatus comprising:

a grid plate including a mask section having a predetermined mask section thickness and having a plurality of apertures through the predetermined mask section thickness in a predetermined pattern such that a respective aperture is locatable over a respective pixel region of the field emission display defined by an intersection of a gate electrode and a cathode electrode; and a plurality of supports having a predetermined support height, each support being mounted from a first substrate facing side of the mask section in a predetermined non-pixel region between apertures such that the mask section is supported by the supports at a predetermined distance from the first substrate;

wherein the predetermined non-pixel region is selected from the group consisting of: a stripe pattern between the apertures in the direction cathode electrodes are formed, a stripe pattern between the apertures in the direction gate electrodes are formed, and a lattice pattern between the apertures in the direction cathode electrodes are formed and in the direction gate electrodes are formed, wherein the grid plate is adapted to receive a predetermined external voltage applied to the grid plate to direct the electrons beams through respective apertures toward the second substrate, wherein the predetermined support height is greater than the predetermined mask section thickness, wherein the supports are made of a conducting material, and wherein the supports taper such that a contacting area of the supports toward the mask section is larger than a contacting area of the supports toward the first substrate.

* * * * *

UNITED STATES PATENT AND TRADEMARK OFFICE

CERTIFICATE OF CORRECTION

PATENT NO. : 7,365,483 B2
APPLICATION NO. : 10/807916
DATED : April 29, 2008
INVENTOR(S) : Eung-Joon Chi It is certified that error appears in the above-identified patent and that said Letters Patent is hereby corrected as shown below:

On the Title Page, item

| | |
|---|---|
| (57) ABSTRACT, line 12 | After "of",<br>Insert --the-- |

In the Claims

| | |
|---|---|
| Column 9, line 18, Claim 1 | Before "same",<br>Insert --the-- |
| Column 10, line 47, Claim 5 | Delete "emiffing",<br>Insert --emitting-- |
| Column 11, line 22, Claim 6 | Delete ".",<br>Insert --,-- |

Signed and Sealed this

Second Day of September, 2008

JON W. DUDAS
*Director of the United States Patent and Trademark Office*